US008692143B2

(12) United States Patent
Schneider

(10) Patent No.: US 8,692,143 B2
(45) Date of Patent: Apr. 8, 2014

(54) CABLE INTERLOCK BETWEEN POWER SWITCHES

(75) Inventor: Bernd Schneider, Bonn (DE)

(73) Assignee: Eaton Industries GmbH, Bonn (DE)

( * ) Notice: Subject to any disclaimer, the term of this patent is extended or adjusted under 35 U.S.C. 154(b) by 515 days.

(21) Appl. No.: 12/866,521

(22) PCT Filed: Jan. 21, 2009

(86) PCT No.: PCT/EP2009/000338
§ 371 (c)(1),
(2), (4) Date: Nov. 3, 2010

(87) PCT Pub. No.: WO2009/097964
PCT Pub. Date: Aug. 13, 2009

(65) Prior Publication Data

US 2011/0036689 A1 Feb. 17, 2011

(30) Foreign Application Priority Data

Feb. 7, 2008 (DE) ..... 10 2008 007 987

(51) Int. Cl.
*H01H 9/26* (2006.01)

(52) U.S. Cl.
USPC ..... 200/5 B

(58) Field of Classification Search
USPC ..... 200/5 B, 5 C, 50.01, 50.33
See application file for complete search history.

(56) References Cited

U.S. PATENT DOCUMENTS

| | | | | |
|---|---|---|---|---|
| 5,892,301 | A | 4/1999 | Warnatz | |
| 6,060,668 | A | 5/2000 | Azzola et al. | |
| 6,225,581 | B1 | 5/2001 | Gerbert-Gaillard et al. | |
| 6,388,214 | B1 | 5/2002 | Jones et al. | |
| 6,486,421 | B1 | 11/2002 | Jones et al. | |
| 2009/0321239 | A1 * | 12/2009 | Zhang | 200/5 B |

FOREIGN PATENT DOCUMENTS

| | | | |
|---|---|---|---|
| DE | 4409172 | A1 | 9/1994 |
| DE | 4409172 | C2 | 12/1995 |
| DE | 19508808 | C1 | 9/1996 |
| EP | 0865054 | A2 | 9/1998 |
| EP | 1026712 | A1 | 8/2000 |
| EP | 1150316 | A2 | 10/2001 |
| EP | 1204127 | A2 | 5/2002 |
| EP | 0853324 | B1 | 9/2003 |

* cited by examiner

*Primary Examiner* — Vanessa Girardi
(74) *Attorney, Agent, or Firm* — Leydig, Voit & Mayer, Ltd.

(57) ABSTRACT

An assembly for mutual mechanical blocking of actuation of a plurality of electrical switches includes a first locking mechanism assigned to a first switch and actuatable by an actuation device of the first switch, the actuation device being configured to transmit via Bowden cables at least one of an OFF position and an ON position of the first switch to a locking device of at least one other locking mechanism assigned to at least one other switch, the locking device including a two-armed rocker having a center portion configured to lock the at least one other switch and having lever arms, each of the lever arms having a respective bore configured to receive: (a) a driving element for a respective Bowden cable so as to provide a mutual locking of three switches, and (b) a fastening pivot pin for rotatable fastening of the two-armed rocker to a mounting plate that accommodates the first locking mechanism, so as to provide a mutual locking of two switches.

8 Claims, 3 Drawing Sheets

CABLE INTERLOCK BETWEEN POWER SWITCHES

CROSS-REFERENCE TO RELATED APPLICATIONS

This is a U.S. national phase application under 35 U.S.C. §371 of International Application No. PCT/EP2009/000338, filed Jan. 21, 2009, and claims benefit of priority under 35 U.S.C. §119 of German Application No. DE 10 2008 007 987.1, filed Feb. 7, 2008.

FIELD

The present invention relates to an assembly for the mutual mechanical blocking of the actuation of at least two electrical switches, in particular power switches.

BACKGROUND

Such assemblies are described in a broad array of design variations, for example, for use with two switches (EP 0 865 054 A2; EP 1 026 712 B1). For the most part, however, assemblies have been described for three switches (EP 0 853 324 B1, EP 1 204 127 A2, DE 195 08 808 C1). The fields of application for such assemblies arise, for example, where there are two separate grid connections, which, in the case of a fault, are replaced by an emergency power generator. The emergency power generator must not be able to be brought onto load when the grid connections are present and vice versa.

The existing assemblies are each conceived and designed for an intended purpose. Such assemblies are then not suited for a second purpose.

An assembly is described (German Examined Patent DE 44 09 172 C2) whereby a locking device for two switches is derived from a locking device for three switches. The locking device has a translationally and rotationally movable coupling element that can be used for the interlocking engagement of three switches in up to seven switch combinations.

SUMMARY

Embodiments of the invention provide an assembly for mutual mechanical blocking of actuation of a plurality of electrical switches. The assembly including a first locking mechanism assigned to a first switch and actuatable by an actuation device of the first switch, the actuation device being configured to transmit via Bowden cables at least one of an OFF position and an ON position of the first switch to a locking device of at least one other locking mechanism assigned to at least one other switch. The locking device includes a two-armed rocker having a center portion configured to lock the at least one other switch and having lever arms, each of the lever arms having a respective bore configured to receive: (a) a driving element for a respective Bowden cable so as to provide a mutual locking of the first switch and the at least one other switch when the at least one other switch is two switches, and (b) a fastening pivot pin for rotatable fastening of the two-armed rocker to a mounting plate that accommodates the first locking mechanism, so as to provide a mutual locking of the first switch and the at least one other switch when the at least one other switch is one switch.

BRIEF DESCRIPTION OF THE DRAWINGS

Further details and advantages of the present invention will become apparent from the following exemplary embodiments that are explained with reference to the figures, which show.

DETAILED DESCRIPTION

Embodiments of the invention provide another assembly for locking electrical switches using fewer components.

In an embodiment, the present invention provides for the locking means to be designed as a two-armed rocker, which, by way of its center portion, is used to lock the switch to be locked and whose lever arms each have a bore into which either driving elements are insertable, each for one Bowden cable, so that the rocker is floating-mounted, or a fastening pivot pin is insertable, for the one-sided and rotatable fastening of the rocker to a plate bearing the locking mechanism. By changing the type of fastening, it is possible to alternate among a plurality of circuit logics of the locking mechanisms in that the rocker design and formation are modified.

The design according to embodiments of the present invention makes it possible to switch from a floating mount of the rocker having two driving elements for one Bowden cable each to a pivot mounting (having only one driving element for one Bowden cable).

The design of the assembly according to an embodiment of the present invention provides for the position of an operating shaft of a first switch to be communicated by a Bowden cable to a locking mechanism which releases or blocks the actuation of at least one further switch, each locking mechanism, that is assigned to a switch, having a rocker which is operatively connected to a locking means (in particular the release lever) of the corresponding switch. The particular locking means are acted upon by one or two Bowden cables. Each locking mechanism has an actuation means from where the locking signals are transmitted via the Bowden cables, whereby a switchover is performed between an ON switch position and an OFF switch position. The actuation is carried out by the operating shaft via a lever mechanism which "takes along" a driving claw which, in turn, moves a link joint into which a Bowden cable is hooked.

The particular advantage of the present invention resides in that, by using simple means and simple manipulations, it is possible to switch from a first linkage logic of the locking mechanism to another linkage logic of the locking mechanism.

The center portion of the rocker is used for acting upon a release lever of the switch to be locked.

The actuation means is operatively connected to the operating shaft of the switch that emits a locking signal.

The rocker is guided in the center portion thereof in a guide opening of the mounting plate.

The distance of the rocker to the release lever of the switch to be locked is determined by the supports configured on the mounting plate that are provided for the sheath of the Bowden cable(s).

The mounting plate may be designed to be mountable on a switch.

The locking assemblies are shown in the figures in a slightly perspective representation.

Figure 1:
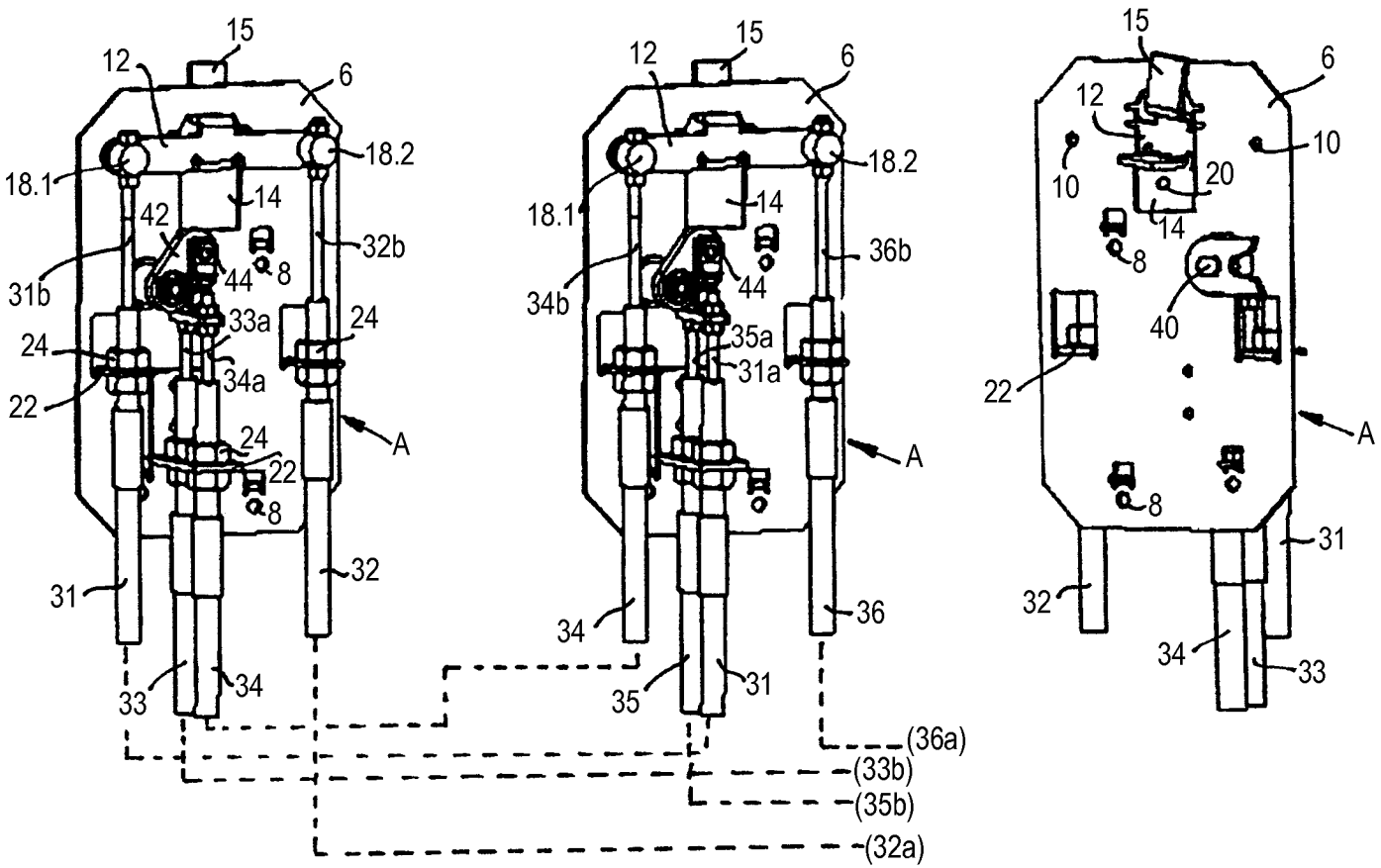
FIG. 1 shows an embodiment of a locking assembly.

Two locking assemblies (A) are drawn side-by-side in FIG. 1. The third view is a rear view of mounting plate 6 (to the right in FIG. 1). With regard to the function of the locking assemblies which are used for the mutual interlocking of power switches, a general explanation is first given. The switches are not drawn. However, they are indicated in the text by reference numerals S1, S2, S3.

The locking assembly is configured on a plate-shaped mounting support 6 that is screw-mountable on a switch or fastenable in some other way. Openings 8 in the mounting plate are used to permit fastening to the switch. Located on the mounting support are lugs 22 which are bent out perpendicularly. They are used as a bearing support for flexible Bowden cables 31 through 36 that serve as mechanical transmission elements for the actuating signals. The Bowden cables are designed as remote controls that are responsive to pull and push actuation. They extend in a sheath that is supported in each instance in lugs 22 by a screw fastening 24. In the region of locking assemblies (A), Bowden cables (31 through 36) extend essentially mutually in parallel.

The 'active' side (reference character a) of a Bowden cable is designed as a link joint 44. Link joint 44 is moved via driving element 42 by rear-side driving claw 40. From there, a locking signal is emitted in response to actuation. The driving claw is actuated by a lever arm on the operating shaft of the switch. The lever arm on the operating shaft moves in such a way that driving claw 40 travels approximately up and down (between the OFF and ON positions) and is actuated by the operating shaft to rotate about an angle of approximately 60°. In the OFF position of the switch, driving claw 40 is at its top position; when the switch is switched ON, driving claw 40 is swiveled by a clockwise rotation to an approximately horizontal position (in the view of the right partial figure of FIG. 1). The motion of driving claw 40 is translated via the pivot pin, which extends through the mounting plate, to a rotation of link joint 44, so that, in the OFF position of the switch (position is reproduced in FIG. 1), the link joint is approximately horizontal and, when the switch is switched ON, it is moved by a counterclockwise rotation to the upward facing position. In this case, the operatively connected Bowden cable is pull-actuated. The locking signal arrives at the 'passive' side (reference character b) of the actuated Bowden cable and transmits the pull motion to rocker 12 of the respectively assigned switch. Passive sides (31*b* through 36*b*) of Bowden cables 31 . . . 36 are hooked into driving elements 18.1, 18.2 on the arms of rocker 12.

A full description of six Bowden cable connections among three switches follows: A first Bowden cable 34 extends from the first locking mechanism of first switch S1, from the actuation means (driving claw and link joint) to the locking means (rocker at the release lever) of second switch S2. A second Bowden cable 33 extends from the same actuation means of first switch S1 to the locking means of a third switch S3. A third Bowden cable 31 extends from the second locking mechanism of second switch S2, from the actuation means of second switch S2 to the locking means of first switch S1; and a fourth Bowden cable 35 extends to the locking means of third switch S3. A fifth Bowden cable 32 extends from the third locking mechanism of third switch S3, from the actuation means of third switch S3 to the locking means of first switch S1; and a sixth Bowden cable 36 extends to the locking means of second switch S2. As mentioned, the actuation means of each switch are rockers 12 which are disposed on the locking mechanisms, are operatively connected to release lever 20 of the respective switch, and which are actuated between an ON switch position to an OFF switch position.

The routing of the Bowden cables between the switches is indicated by a dashed line in FIG. 1. The position of rocker 12 and the tilting of link joint 44 do not coincide due to the schematic representation of second locking mechanism A (in identical position as that of the first locking mechanism). However, one skilled in the art recognizes that the rocker of the locking mechanism (FIG. 1, in the middle) swivels in each case in response to locking signal 34*b* when link joint 44 of first locking mechanism A (FIG. 1, on the left) is moved downwards (when the switch is OFF) and upwards (when the switch is ON).

Rocker 12 has a two-armed design and is guided in the center portion thereof in a guide opening 14. The position of mounting support 6 of locking assembly (A) and, thus, also that of guide opening 14 is such that a free end of release lever 20 of the switch comes to rest in guide opening 14.

In the right partial figure of FIG. 1, mounting plate 6 of a locking mechanism A is shown from the rear side thereof. Fastening openings 8 and a guide opening 14 for rocker 12 are discernible. Release lever 20 of the assigned switch reaches through guide opening 14. Release lever 20 is actuated by a rearward angled stop plate 19 of the rocker. Rocker 12 may be moved within guide opening 14 parallel to itself and rotated by an angle W (see FIG. 4). On the rear side of mounting plate 6, driving claw 40 is likewise visible, which—as already mentioned—is moved by the lever mechanism of the operating shaft of the switch. In FIG. 1 (to the right), driving claw 40 is in the horizontal position that it assumes when the switch is in the ON position. As mentioned, the driving claw is used for emitting a locking signal.

The configuration of Bowden cables (31 through 36) relative to rocker 12 is significant for the switching logic and, thus, for the mode of operation of the locking assemblies. The distance between the center portion of the rocker and release lever 20 is smaller or greater depending on the positioning of rocker 12. The rocker positioning discussed here is an important inventive feature and will be clarified in greater detail below.

Figure 2:
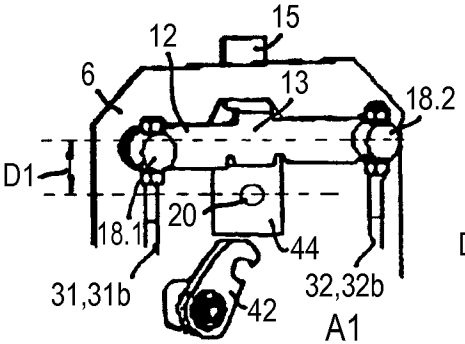
FIG. 2 shows an embodiment of a locking assembly of type A.

Locking Mechanism of the First Type and Positioning A1 of the Rocker (FIG. 2)

Rocker 12 is mounted so as to be free-floating (only guided in guide opening 14) in support plate 6 of switch S, at a substantial distance D1 to release lever 20. Bowden cables 31, 32 are fastened in driving elements 18.1 and 18.2 on the rocker arms. Distance D1 is set in screw fastenings 24 of the Bowden cables on lugs 22. The initial position (without signal input) of the rocker is approximately horizontal (normal position). To secure the rocker in the relaxed state of Bowden cables (31 . . . 36), the rocker has a guide tab 15 disposed thereon which comes to rest on the rear side of supporting plate 6. The two other assigned switches, from where the locking signals originate, are in the OFF position. Driving elements 42 for link joint 44 of the assigned switches are in a raised position (see FIG. 4). In response to a one-sided tensile load (a first locking signal, for example via Bowden cable 31), the rocker tilts by an angle W in the direction of the actuated Bowden cable, thereby reducing the distance to release lever 20. However, release lever 20 is not yet actuated. In response to actuation of the two Bowden cables 31 and 32 (two locking signals 31*b*, 32*b*)—which may take place simultaneously or one after the other—the rocker is displaced essentially in parallel to the initial position thereof. Only then is release lever 20 actuated (signal output). The locking mechanism of type A functions by logical AND operation; it is used as an AND element. One of the switches actuated by two Bowden cables (31 AND 32) is no longer able to be switched ON and is locked in its OFF position. Thus, this switch is locked against a switching-on operation when the locking signals are emitted in response to the closing of the two other switches.

Figure 3:
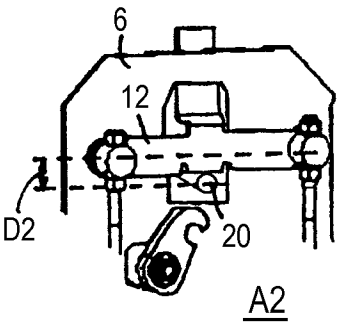
FIG. 3 shows an embodiment of a locking assembly of type B.

Locking Mechanism of the Second Type and Positioning A2 of the Rocker (FIG. 3)

Just as in the case of positioning A1, rocker 12 is mounted so as to be free-floating, however, at a small distance D2 to release lever 20. Bowden cables 31, 32 are likewise fastened in driving elements 18.1 and 18.2 on rocker arms 12.1, 12.2. When no tensile load is exerted by the Bowden cables (no locking signal), the rocker is likewise disposed horizontally (normal position). In response to a one-sided tensile load (a first locking signal), the rocker tilts in the direction of the actuated Bowden cable, thereby actuating release lever 20, so that it is no longer able to be switched ON by a switch actuated by a Bowden cable. The actuation of the second Bowden cable also leads to the same action.

Figure 4:
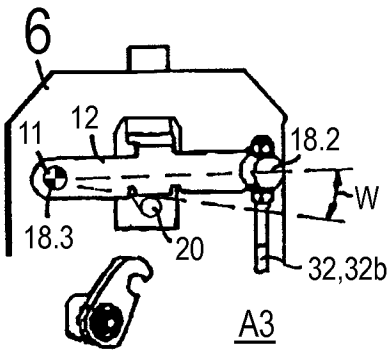
FIG. 4 shows an embodiment of a locking assembly of type C.

Locking Mechanism of the Third Type and Positioning A3 of the Rocker (FIG. 4)

Besides the previously described types, the present invention provides another type. The rocker is fixed at one end of the arms thereof via a pivot pin 11 in a fixed bearing 18.3 on mounting plate 6 of the switch. Depending on the structural and geometric properties, the left or the right rocker arm may be fixed. In this design of locking mechanism A3, the rocker may be acted upon by only one single Bowden cable (32) at the free end (driving element 18.2) of the rocker. Rocker 12 is in the horizontal position, again, in the initial position of the rocker (no locking signal). As in FIG. 2, the distance of the center portion of the rocker is small, so that center portion 13 (stop plate 19; see FIG. 5) comes virtually to a contact-making with release lever 20. In response to a tensile load exerted by the one Bowden cable 32 (incoming locking signal 32*b*), the rocker is rotated about fixed bearing 18.3 by an angle W, release lever 20 being thereby nudged, and the latching mechanism of the switch being triggered. In the case of positioning A3, a second Bowden cable is not provided since the fixing-in-place of the second rocker arm prevents it from receiving any locking signal. By combining it with a second switch from where the locking signal is transmitted, the first switch is lockable when the second switch reaches an ON position.

Figure 5:
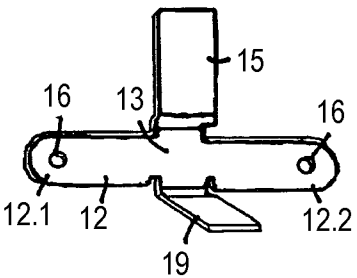
FIG. 5 shows an embodiment of the rocker of the locking assembly.

Rocker 12 of the locking assembly is shown as an individual part in FIG. 5. Formed on center portion 13 is an angled and perpendicularly upwardly projecting guide tab 15 which reaches through guide opening 14 of mounting plate 6 and, in this manner, comes to rest on the rear side of mounting plate 6. The rocker may be guided by the guide elements so as to be free-floating, its position (horizontal or tilted) being determined by the position of the Bowden cables and the adjustment of support (24) for the sheath of a Bowden cable via screw fastening 24 on lug 22. The perpendicularly angled stop plate 19 of the rocker that is formed to the rear and underneath on center portion 13 is used for actuating release lever 20. Bores 16, which are used for receiving driving elements 18.1 and 18.2 for the Bowden cables when two Bowden cables (31, 32) are used, are formed on lever arms 12.1, 12.2. In the case that a locking mechanism of type A3 (FIG. 4) is used, only one driving element is used. Second bore 16 is used as a bearing for a fastening pivot pin 11, so that the rocker is rotatably mounted on mounting plate 6. Mating bores 10 (see FIG. 1 to the right) are provided at appropriate locations on mounting plate 6. Either a right or left position is selected for the rocker in one of the two bores 10 to permit adaptation to the particular use.

Figure 6:
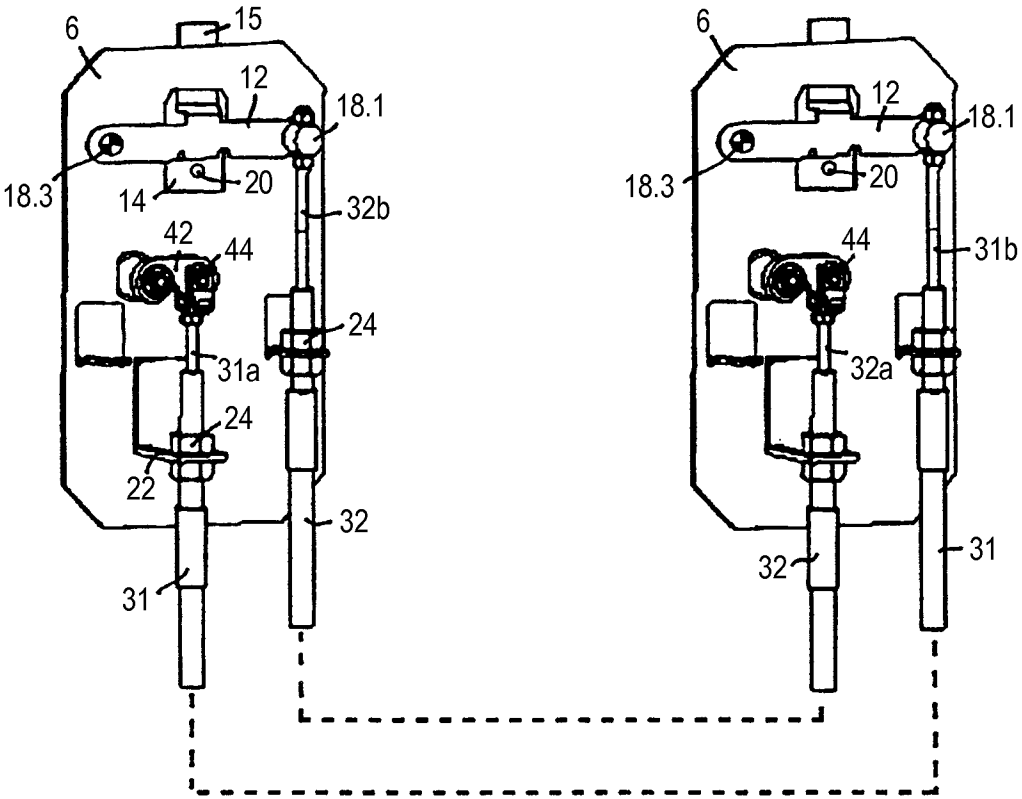
FIG. 6 shows an embodiment of a locking assembly for use with only two switches.

FIG. 6 shows two locking mechanisms having the design of type A3 that are each configured on a switch—in the case of an OFF switch position. One on side, rocker 12 is rotatably secured about bearing 18.3. Only two Bowden cables 31, 32 are used. The operative connection with respect to the locking signals is represented by reference numerals 31*a*, 32*a* (outgoing locking signal) and 31*b*, 32*b* (incoming locking signal). In response to a switch actuation by an ON-switching action, driving element 42 moves upward and pulls the corresponding Bowden cable for the second switch downward, whereby release lever 20 is actuated by the rocker of the second switch. The latching mechanism of the second switch is triggered; the second switch is no longer able to be switched on. One of the two switches can only be closed when the other is open. If a first switch is closed, it is not possible for the second to also be closed.

By combining the locking mechanisms shown in FIGS. 2, 3 and 4 on the switches, it is possible to form different switching logics.

Switching Logic 1

When one switch is closed (ON=1), the other two cannot be closed.

| Possible switch states | | |
|---|---|---|
| S1 | S2 | S3 |
| 0 | 0 | 0 |
| I | 0 | 0 |
| 0 | I | 0 |
| 0 | 0 | I |

To this end, the locking mechanisms are combined as follows: the locking mechanisms of all three switches are of type A2.

Switching Logic II

Two switches (S1, S2) can be independently opened or closed. Third switch (S3) can only be closed when the other two are opened. When third switch (S3) is closed, the other two are not able to be closed.

| Possible switch states | | |
|---|---|---|
| S1 | S2 | S3 |
| 0 | 0 | 0 |
| I | 0 | 0 |
| 0 | I | 0 |
| I | I | 0 |
| 0 | 0 | I |

To this end, the locking mechanisms are combined as follows: The locking mechanisms of the first and second switch are of type A3, and the locking mechanism of the third switch is of type A2.

Switching Logic III

No matter which two switches are closed (ON=1), the third is locked (blocked).

| Possible switch states | | |
|---|---|---|
| S1 | S2 | S3 |
| 0 | 0 | 0 |
| I | 0 | 0 |
| 0 | I | 0 |
| 0 | 0 | I |
| 0 | I | I |

-continued

| Possible switch states | | |
|---|---|---|
| S1 | S2 | S3 |
| I | I | 0 |
| I | 0 | I |

To this end, the locking mechanisms are combined as follows: the locking mechanisms of all three switches are of type A1.

Switching Logic IV

A switch may only be closed when the other is open.

| Possible switch states | |
|---|---|
| S1 | S2 |
| 0 | 0 |
| I | 0 |
| 0 | I |

To this end, the locking mechanisms in accordance with FIG. 6 are combined for two switches (S1, S2), thus twice the number for type A3.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

| LIST OF REFERENCE NUMERALS | |
|---|---|
| A1 A2 A3 | locking mechanisms |
| D1 D2 | distances |
| S1 S2 S3 | switches |
| W | angle |
| 6 | mounting plate (support for the locking assembly) |
| 8 | fastening openings |
| 10 | bore for fixing the rocker in place |
| 11 | pivot pin |
| 12 | rocker |
| 12.1 12.2 | lever arms |
| 13 | center portion |
| 14 | guide opening (for guiding the rocker) |
| 15 | guide tab |
| 16 | bores |
| 18.1 | first driving element on the rocker |
| 18.2 | second driving element on the rocker |
| 18.3 | fixed bearing for rocker |
| 19 | stop plate |
| 20 | locking means, release lever |
| 22 | lug as bearing for Bowden cable |
| 24 | support for the sheath of a Bowden cable |
| 31 . . . 36 | Bowden cable |
| 31a . . . 36a | locking signal input |
| 31b . . . 36b | locking signal output |
| 40 | driving claw for operating-shaft lever mechanism (on the rear side of the mounting plate) |
| 42 | driving element for the link joint (on the front side of the mounting plate) |
| 44 | link joint |

The invention claimed is:

1. An assembly for mutual mechanical blocking of actuation of a plurality of electrical switches comprising:

a first locking mechanism assigned to a first switch and actuatable by an actuation device of the first switch, the actuation device being configured to transmit via Bowden cables at least one of an OFF position and an ON position of the first switch to a locking device of at least one other locking mechanism assigned to at least one other switch;

the locking device including a two-armed rocker having a center portion configured to lock the at least one other switch and having lever arms, a first of the lever arms having a first bore configured to receive a driving element of one of the Bowden cables and a second of the lever arms having a second bore configured to receive:

(a) a driving element of another one of the Bowden cable so as to provide a mutual locking of the first switch and the at least one other switch when the at least one other switch is two switches; and (b) a fastening pivot pin for rotatable fastening of the two-armed rocker to a mounting plate that accommodates the first locking mechanism so as to provide a mutual locking of the first switch and the at least one other switch when the at least one other switch is one switch, and wherein the center portion of the two-armed rocker is configured to act on a release lever of the at least one other switch.

2. The assembly as recited in claim 1, wherein the actuation device is operatively connected to an operating shaft of the at least one other switch, the at least one other switch emitting a locking signal.

3. The assembly as recited in claim 1, wherein the two-armed rocker is guided in the center portion thereof in a guide opening of the mounting plate.

4. The assembly as recited in claim 1, wherein the mounting plate is disposed on at least one of the plurality of switches.

5. The assembly as recited in claim 1, wherein the Bowden cables include a remote control responsive to pull and push actuation.

6. The assembly as recited in claim 1, wherein the electrical switches are power switches.

7. The assembly as recited in claim 1, wherein a distance of the two-armed rocker to the release lever is determined by a support for a sheath of one of the Bowden cables, the support being disposed on the mounting plate.

8. An assembly for mutual mechanical blocking of actuation of a plurality of electrical switches comprising:

a mounting plate;

a first locking mechanism assigned to a first switch and actuatable by an actuation device of the first switch;

at least one other locking mechanism assigned to at least one other switch including a locking device configured to receive via Bowden cables at least one of an OFF position and an ON position of the first switch, the locking device being configured as a two-armed rocker with first and second lever arms and a center portion, the first lever arm including a first bore having a driving element of one of the Bowden cables and the second lever arm including a second bore having:

(a) a driving element for another one of the Bowden cables in a mutual locking of three switches; and (b) a fastening pivot pin rotatably fastening the two-armed rocker to the mounting plate in a mutual locking of two switches, and wherein the center portion of the two-armed rocker is configured to act on a release lever of the at least one other switch.

* * * * *